US010876462B1

(12) United States Patent
Draisey et al.

(10) Patent No.: US 10,876,462 B1
(45) Date of Patent: Dec. 29, 2020

(54) COOLANT JACKET INSERT

(71) Applicant: Ford Global Technologies, LLC, Dearborn, MI (US)

(72) Inventors: Michael Draisey, Concord, NC (US); Cem Demirkesen, Istanbul (TR)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/516,124

(22) Filed: Jul. 18, 2019

(51) Int. Cl.
*F02F 1/14* (2006.01)
*F01P 3/02* (2006.01)
*F02F 1/10* (2006.01)

(52) U.S. Cl.
CPC ..... *F01P 3/02* (2013.01); *F02F 1/108* (2013.01); *F02F 1/14* (2013.01); *F01P 2003/021* (2013.01); *F01P 2003/024* (2013.01); *F01P 2025/31* (2013.01); *F02F 2001/104* (2013.01)

(58) Field of Classification Search
CPC ..... F02F 1/14; F02F 1/004; F02F 1/40; F02F 1/16; F02F 1/10; F02F 1/36; F02F 2001/104; F02F 11/002; F02F 11/005; F02F 2001/106; F01P 3/02; F01P 2003/027
USPC ..... 123/41.72
See application file for complete search history.

(56) References Cited

U.S. PATENT DOCUMENTS 3,659,569 A * 5/1972 Mayer ..... F02F 1/16 123/41.79
3,672,263 A * 6/1972 Mirjanic ..... F02F 1/14 92/144
4,590,894 A 5/1986 Ishida et al.
6,223,702 B1 * 5/2001 Achenbach ..... F02F 1/10 123/41.71
6,349,697 B1 * 2/2002 Kanda ..... F02B 17/005 123/295
6,581,550 B2 * 6/2003 Shinpo ..... F01P 3/02 123/41.74
6,732,679 B2 5/2004 Iizuka
7,021,250 B2 * 4/2006 Marinica ..... F01P 3/02 123/41.72
7,032,547 B2 * 4/2006 Xin ..... F02F 1/108 123/41.72
7,798,108 B2 9/2010 Konishi et al.
9,874,133 B2 * 1/2018 Maier ..... F01P 7/165
2003/0230254 A1 * 12/2003 Matsutani ..... F01P 3/02 123/41.79
2012/0132155 A1 5/2012 Smith et al.
(Continued)

FOREIGN PATENT DOCUMENTS

EP 0239997 A2 * 10/1987 ..... F01P 3/02
EP 1158154 A2 * 11/2001 ..... F02F 1/16
(Continued)

OTHER PUBLICATIONS

JP 2018123742 English Translation.*

*Primary Examiner* — George C Jin
*Assistant Examiner* — Teuta B Holbrook
(74) *Attorney, Agent, or Firm* — Geoffrey Brumbaugh; McCoy Russell LLP

(57) ABSTRACT

Methods and systems are provided for a coolant jacket insert. In one example, a system may include a coolant jacket arranged in a block comprising an insert with a first internal passage configured to direct coolant from an inlet manifold of the coolant jacket directly to a portion of the coolant jacket arranged in a cylinder head.

19 Claims, 9 Drawing Sheets

(56) References Cited

U.S. PATENT DOCUMENTS

| | | | | |
|---|---|---|---|---|
| 2015/0034028 | A1 | 2/2015 | Zahdeh et al. | |
| 2015/0345363 | A1* | 12/2015 | Marutani | F02F 1/166<br>123/41.44 |
| 2016/0230696 | A1 | 8/2016 | Williams et al. | |
| 2017/0342939 | A1* | 11/2017 | Araki | F01P 3/02 |
| 2017/0350302 | A1* | 12/2017 | Araki | F02F 1/14 |
| 2018/0135504 | A1 | 5/2018 | Quix et al. | |

FOREIGN PATENT DOCUMENTS

| | | | | |
|---|---|---|---|---|
| JP | 2018123742 | A * | 8/2018 | |
| WO | WO-9103632 | A1 * | 3/1991 | F01P 3/02 |

* cited by examiner

COOLANT JACKET INSERT

FIELD

The present description relates generally to an insert for a coolant jacket of an engine

BACKGROUND/SUMMARY

Turbochargers are becoming a ubiquitous component for vehicles comprising an internal combustion engine. Turbochargers may decrease fuel consumption and improve efficiency of the vehicle, thereby decreasing greenhouse gas emissions. However, turbochargers also increase a thermal load of the engine, which may result in premature degradation of the engine if cooling demands are not met.

Examples of cooling arrangements for cooling turbocharger engines may include a cooling arrangement comprising two or more ducts configured to divert coolant flow through a coolant jacket of an engine. One example is shown by Quix et al. in U.S. 2018/0135504. Therein, a first coolant duct diverts coolant to an area between cylinder liners and a cylinder block. A second coolant duct diverts coolant to an area between adjacent cylinder liners. In this way, the cooling arrangement promotes coolant flow around an entire circumference of the cylinder liners to mitigate warping and other types of degradation associated with cylinder liners overheating.

However, the inventors have identified some issues with the approaches described above. For example, a coolant inlet manifold of the cylinder block may not evenly guide coolant to each of the cylinders of a cylinder bank. As such, a leading cylinder may receive more coolant than a trailing cylinder. This uneven coolant distribution may result in degradation at the trailing cylinder. Additionally, cooling demands in the cylinder head may be greater than cooling demands in the cylinder block. In the previous example and in many other examples of cooling arrangements, coolant entering the cylinder block via the coolant inlet manifold is forced to flow around at least a portion of the coolant jacket arranged adjacent to the cylinder block before flowing to the portion of the coolant jacket in the cylinder head. This delay in coolant flow may result in degradation of the cylinder head and/or components arranged therein (e.g., poppet valves, spark plug, fuel injector, etc.).

In one example, the issues described above may be addressed by a system for an insert arranged in a portion of a coolant jacket in a block, wherein the insert comprises a first internal passage configured to flow coolant directly to a portion of the coolant jacket in a head without mixing with coolant in the portion of the coolant jacket in the block. In this way, coolant may be quickly directed to hotter portions of an engine.

As one example, the insert further comprises a second internal passage and a third internal passage configured to direct coolant to an upper region of the portion of the coolant jacket in the block. The second internal passage and the third internal passage may direct coolant flows in opposite directions within the upper region. The coolant flows may collide in a region adjacent to a space between adjacent cylinders, wherein the collision, along with fins of the cylinder liners, may promote coolant flow to the space between adjacent cylinders. By doing this, cooling demands of the cylinder head and the cylinder block may be realized via the insert.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2 through 9 are shown to scale, however, other dimensions may be used.

DETAILED DESCRIPTION

The following description relates to systems and methods for a coolant chamber insert. In one example, the coolant chamber insert is a coolant jacket stuffer. The engine may be included in a hybrid vehicle, such as the hybrid vehicle illustrated in FIG. 1. In some examples, the engine may be turbocharged and/or supercharged. However, it will be appreciated that the engine may be a non-turbocharged and/or a non-supercharged engine without departing from the scope of the present disclosure. The coolant jacket stuffer may be arranged in a coolant jacket of the engine of the hybrid vehicle. The coolant jacket stuffer is arranged in a portion of the coolant jacket sandwiched between the engine block and a cylinder liner. The coolant jacket stuffer abutted with the block is illustrated in FIG. 2.

The coolant jacket in which the coolant jacket stuffer is arranged may comprise a first portion in the cylinder block and a second portion in the cylinder head, wherein the coolant jacket stuffer is arranged only in the first portion. As such, the coolant jacket stuffer may not extend into the second portion in the cylinder head. However, the coolant jacket stuffer may comprise one or more passages fluidly coupling the first portion directly to the second portion. The first portion may receive coolant from a coolant inlet manifold as shown in FIG. 2. The coolant jacket stuffer may be configured to promote even coolant distribution from the coolant inlet manifold to each section of the first portion corresponding to a cylinder of the cylinders of a cylinder bank. For example, in the example of FIG. 2, the cylinder bank comprises four cylinders. The coolant jacket stuffer is shaped to promote substantially even coolant distribution to each section of the first portion corresponding to each one of the four cylinders so that a desired thermal management of each cylinder is realized.

Figures 3A, 3B:
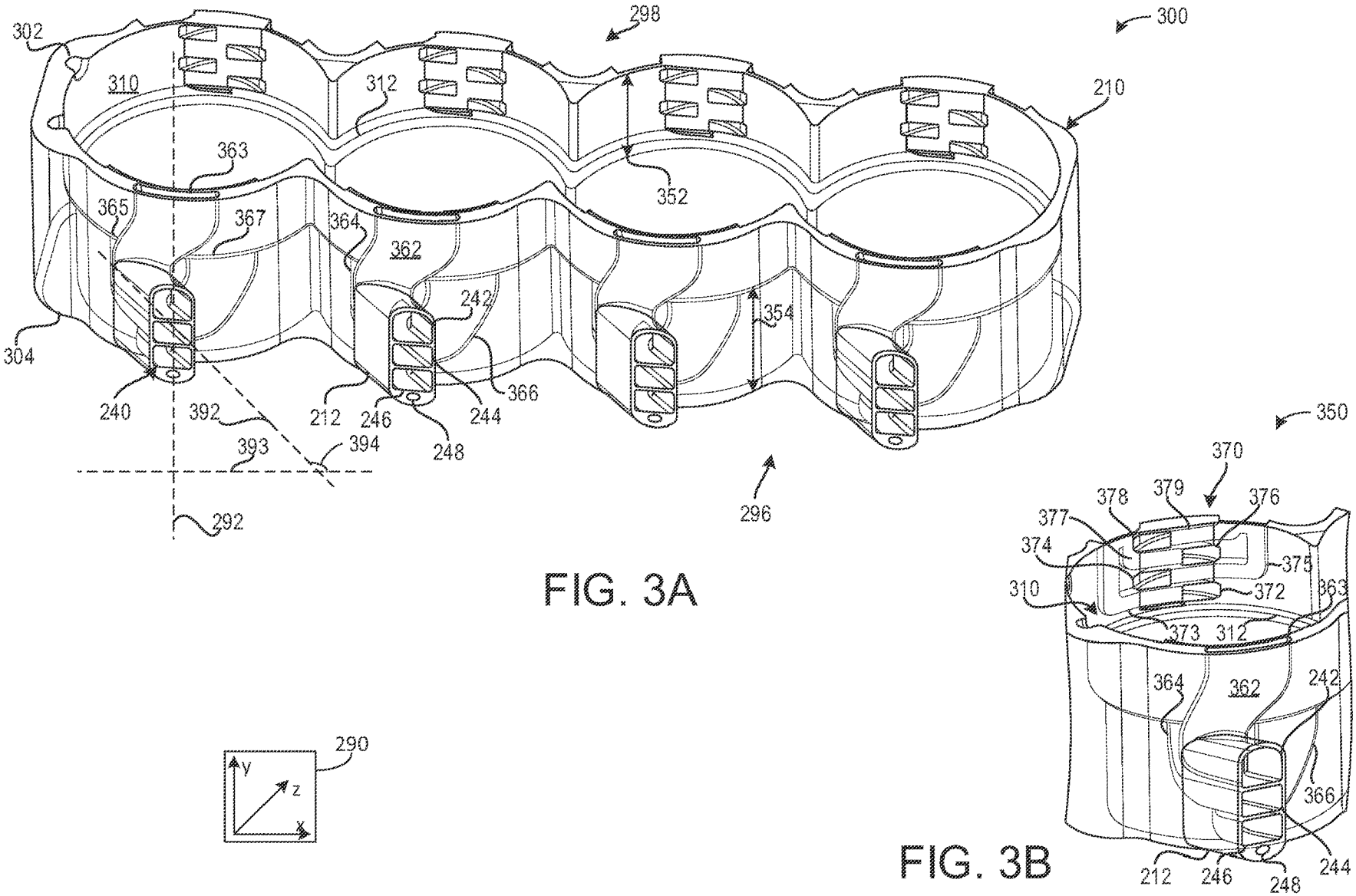
FIG. 3A illustrates a perspective view of an intake side of the coolant jacket stuffer.
FIG. 3B illustrates a perspective view of a portion of the coolant jacket stuffer.
Figure 4A:
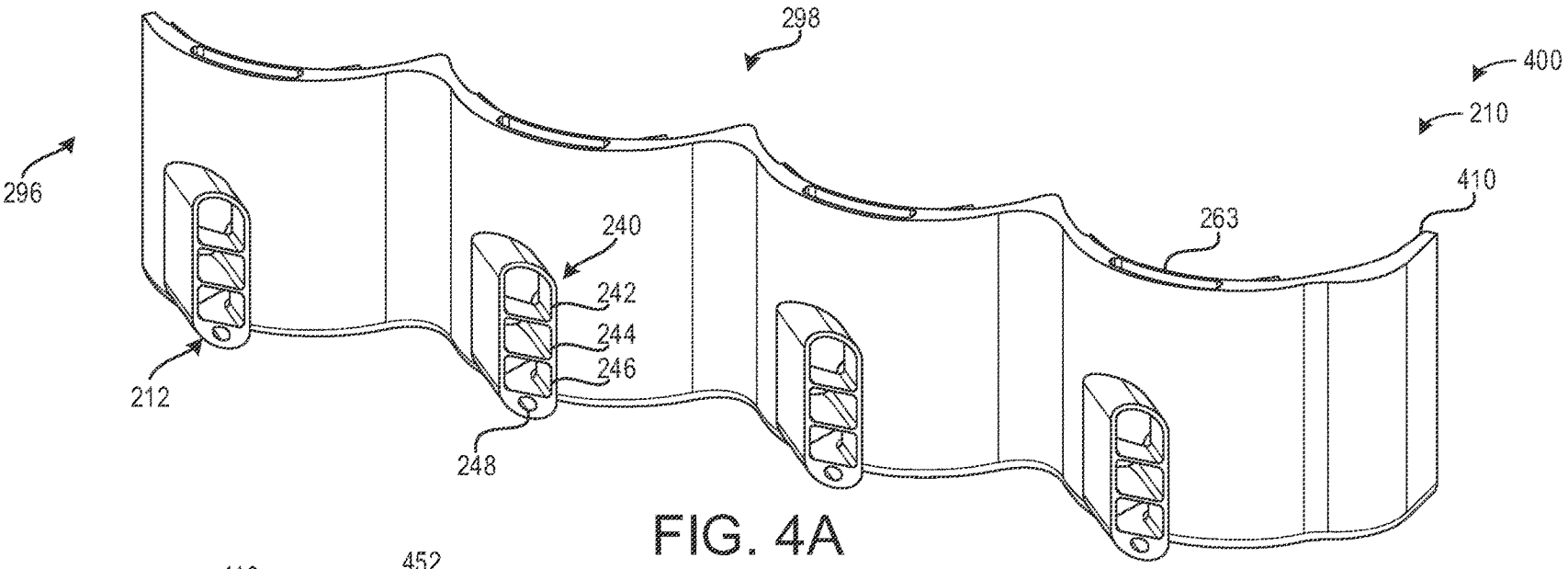
FIG. 4A illustrates an exterior view of an intake side of the coolant jacket stuffer.
Figure 4B:
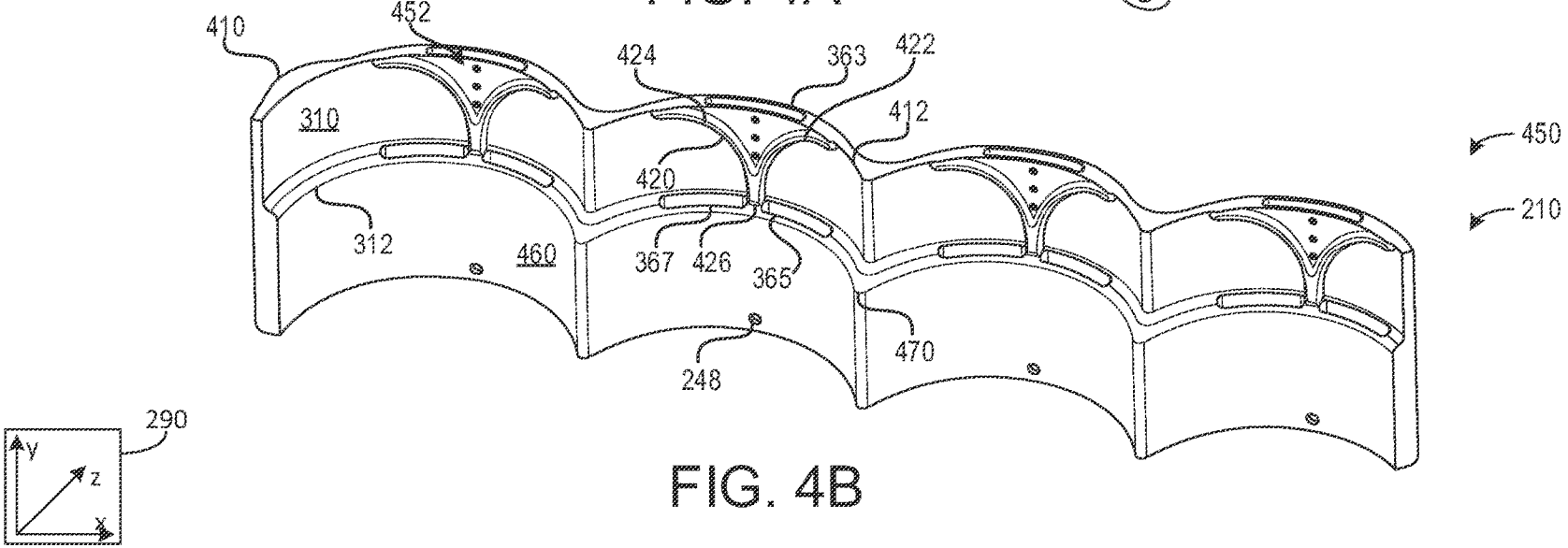
FIG. 4B illustrates an interior view of an intake side of the coolant jacket stuffer.

The water jacket stuffer comprises one or more features shaped to direct coolant flow within the water jacket to an upper portion of the water jacket toward the head, as shown in FIG. 3A. The water jacket stuffer may further comprise alternating passages arranged on an exhaust side of the stuffer shaped to direct coolant to the head, as shown in FIG. 3B. FIG. 4A illustrates an extension arranged on a first piece of the water jacket stuffer. FIG. 4B illustrates a flow directing feature arranged on an interior side of the first piece of the water jacket stuffer. The flow directing features comprises a wish bone shape (e.g., a Y-shape wherein two of the three prongs are curved).

Figure 5A:
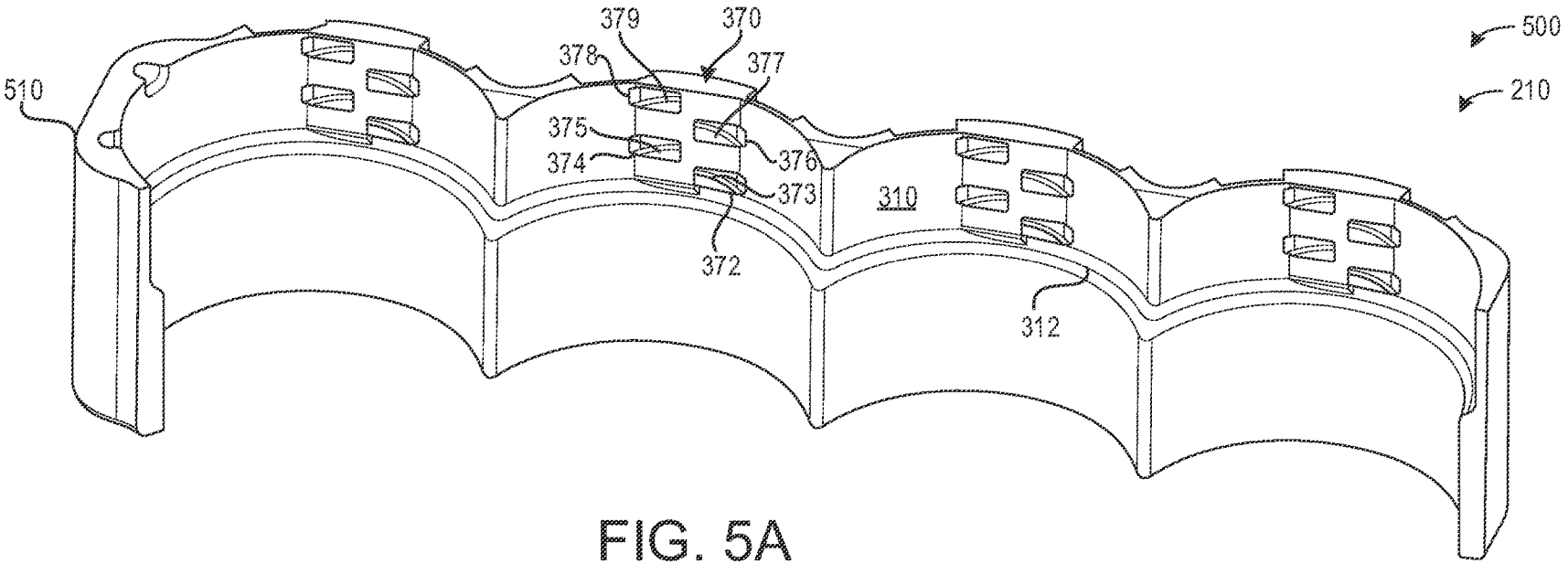
FIG. 5A illustrates an interior view of an exhaust side of the coolant jacket stuffer.
Figure 5B:
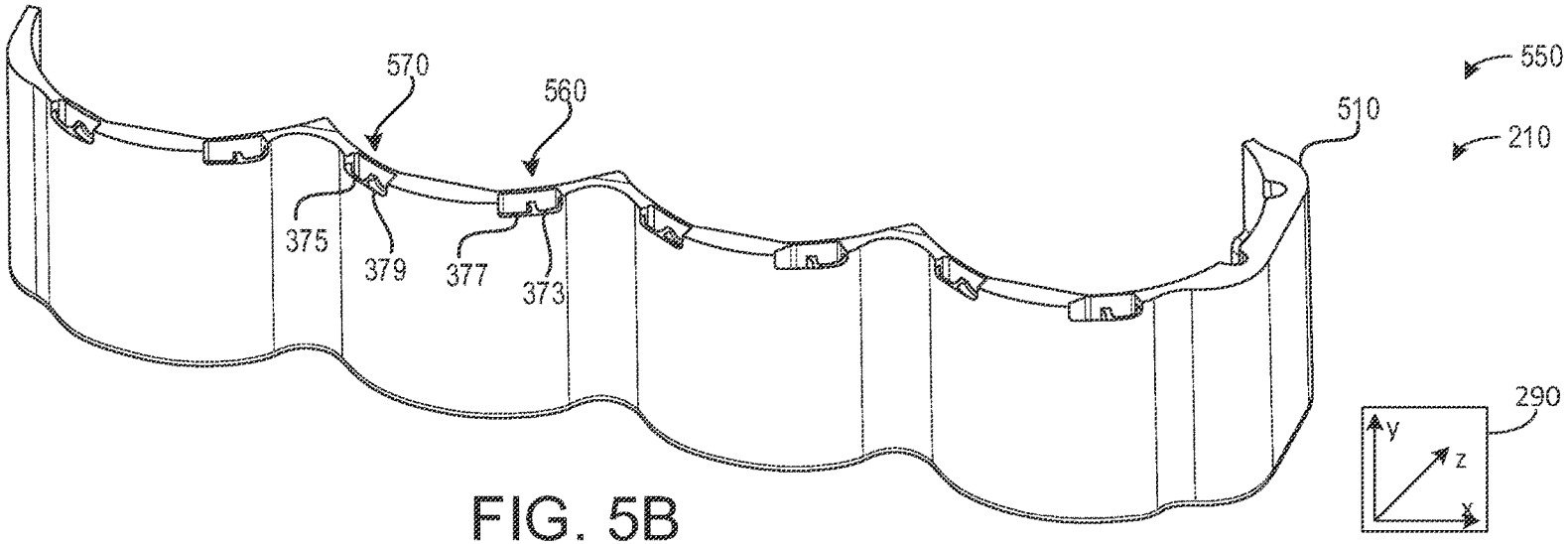
FIG. 5B illustrates an exterior view of an exhaust side of the coolant jacket stuffer.
Figure 6:
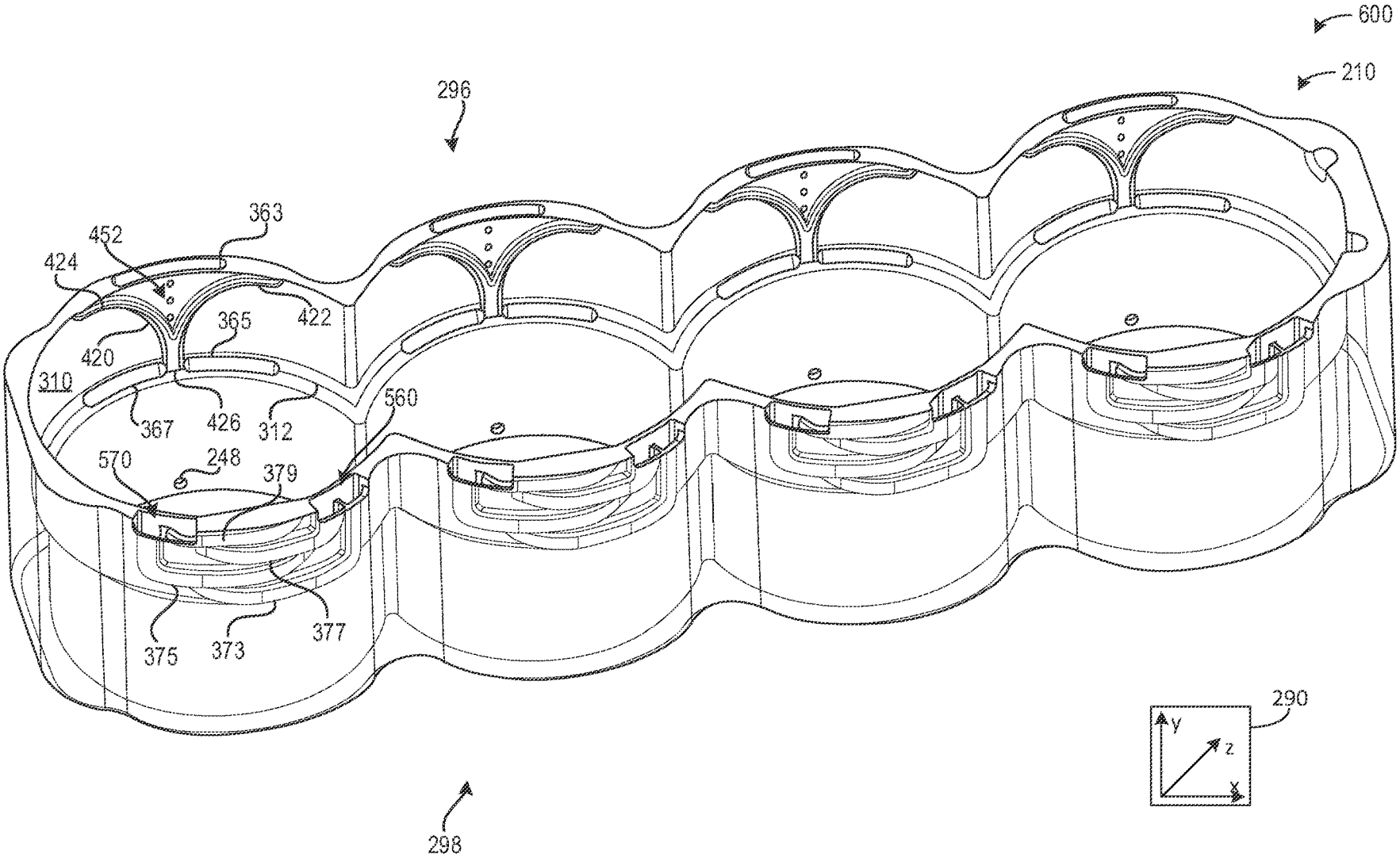
FIG. 6 illustrates a perspective view from the exhaust side of the coolant jacket stuffer.
Figure 7B:
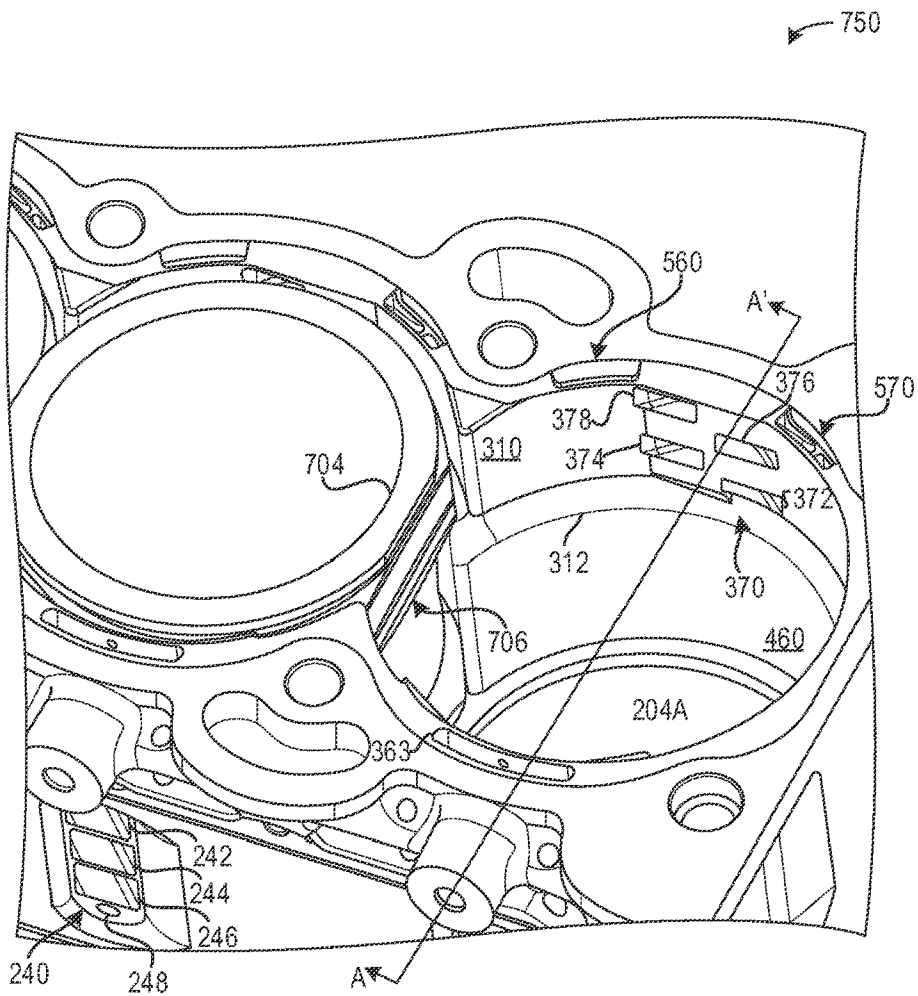
FIG. 7B illustrates a perspective view of the water jacket stuffer arranged adjacent to the cylinder line from an intake side.
Figure 7A:
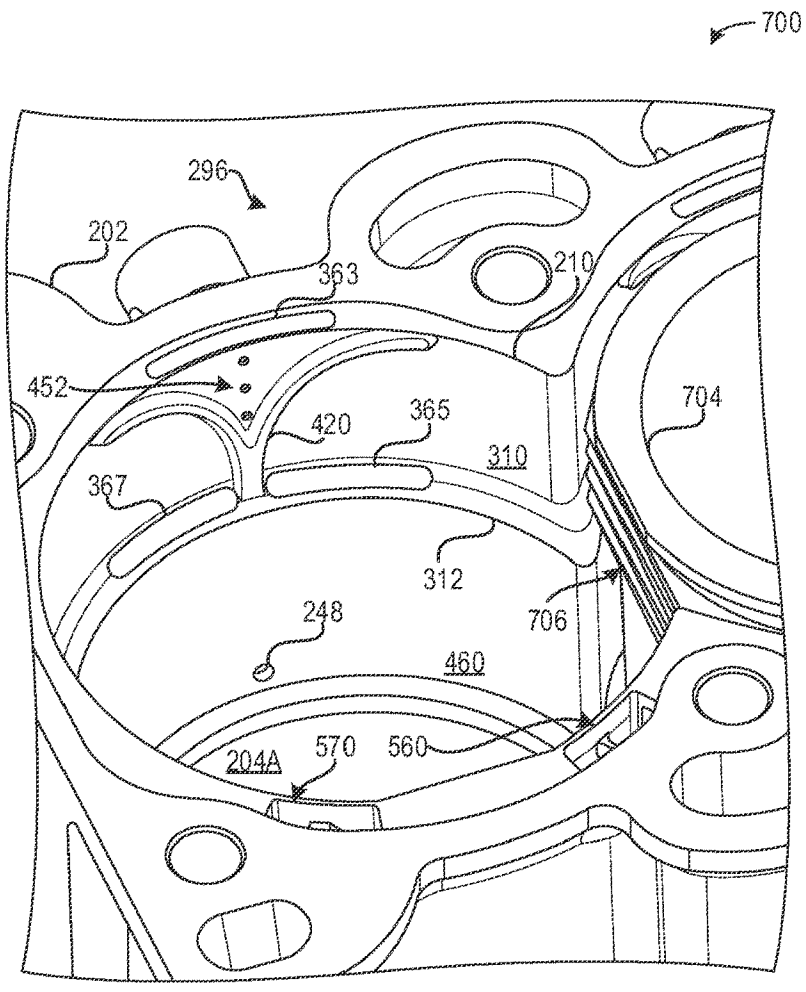
FIG. 7A illustrates a perspective view of the coolant jacket stuffer arranged adjacent to a cylinder liner from an exhaust side.
Figure 8:
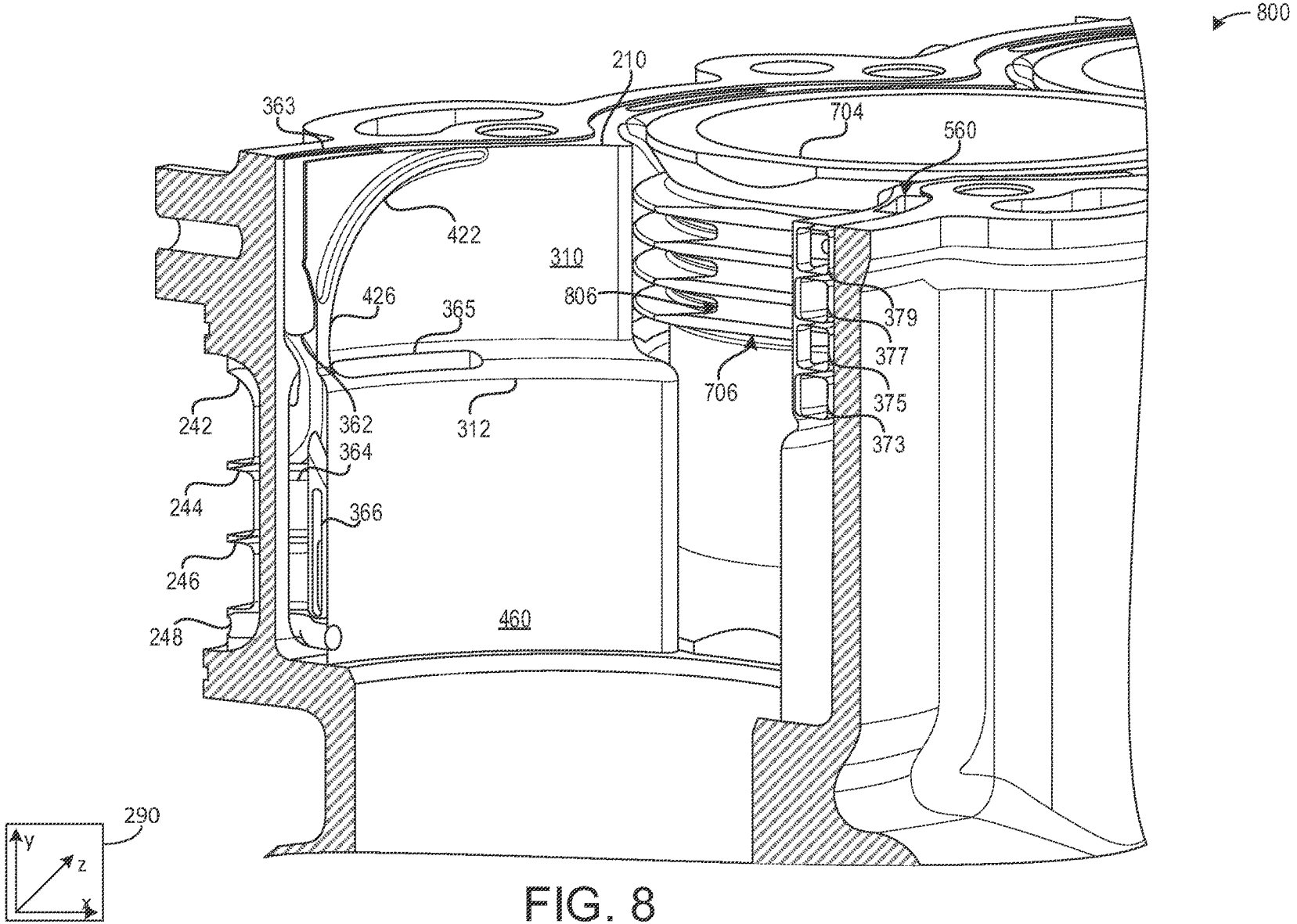
FIG. 8 illustrates a cross-sectional view taken along the plane A-A' of FIG. 7B.
Figure 9:
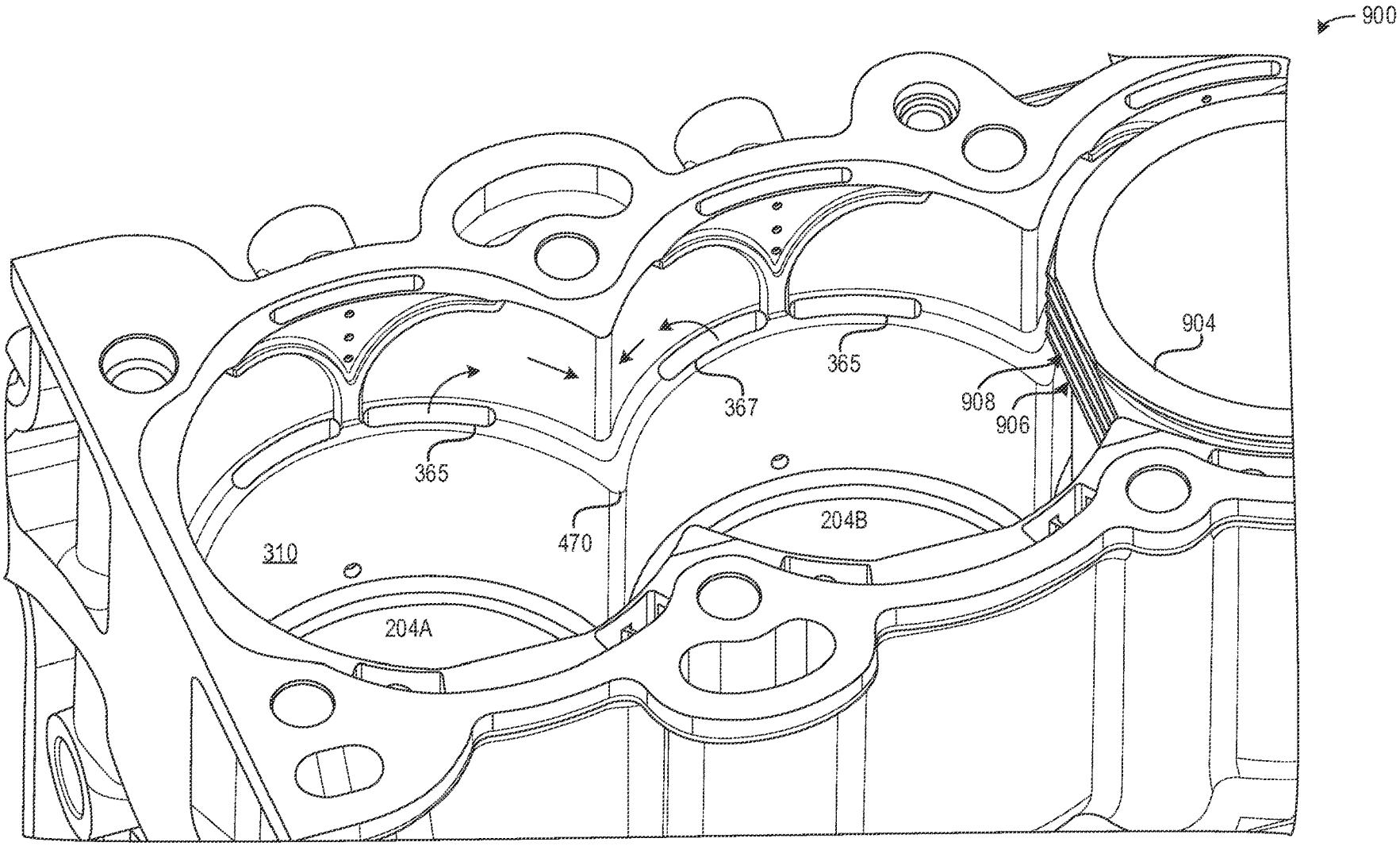
FIG. 9 illustrates a perspective view from an exhaust side of the coolant jacket stuffer.

The water jacket stuffer further comprises alternating outlet passages that are misaligned with one another. The outlet passages may direct coolant to the cylinder head with corresponding outlets. The outlet passages and their corresponding outlets are shown in FIGS. 5A and 5B. FIG. 6 illustrates cutouts of the insert shaped to direct coolant flow within the water jacket. FIG. 7A illustrates the water jacket stuffer interacting with a cylinder liner of an adjacent cylinder from an exhaust side. FIG. 7B illustrates the water jacket stuffer interacting with the cylinder liner of the adjacent cylinder from an intake side. FIG. 8 illustrates a cross-section of the insert. FIG. 9 shows a view of the block with two cylinder liners removed. Adjacent portions of the insert may work synergistically to promote coolant flow around the upper region toward the alternating passages.

FIGS. 1-9 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Figure 1:
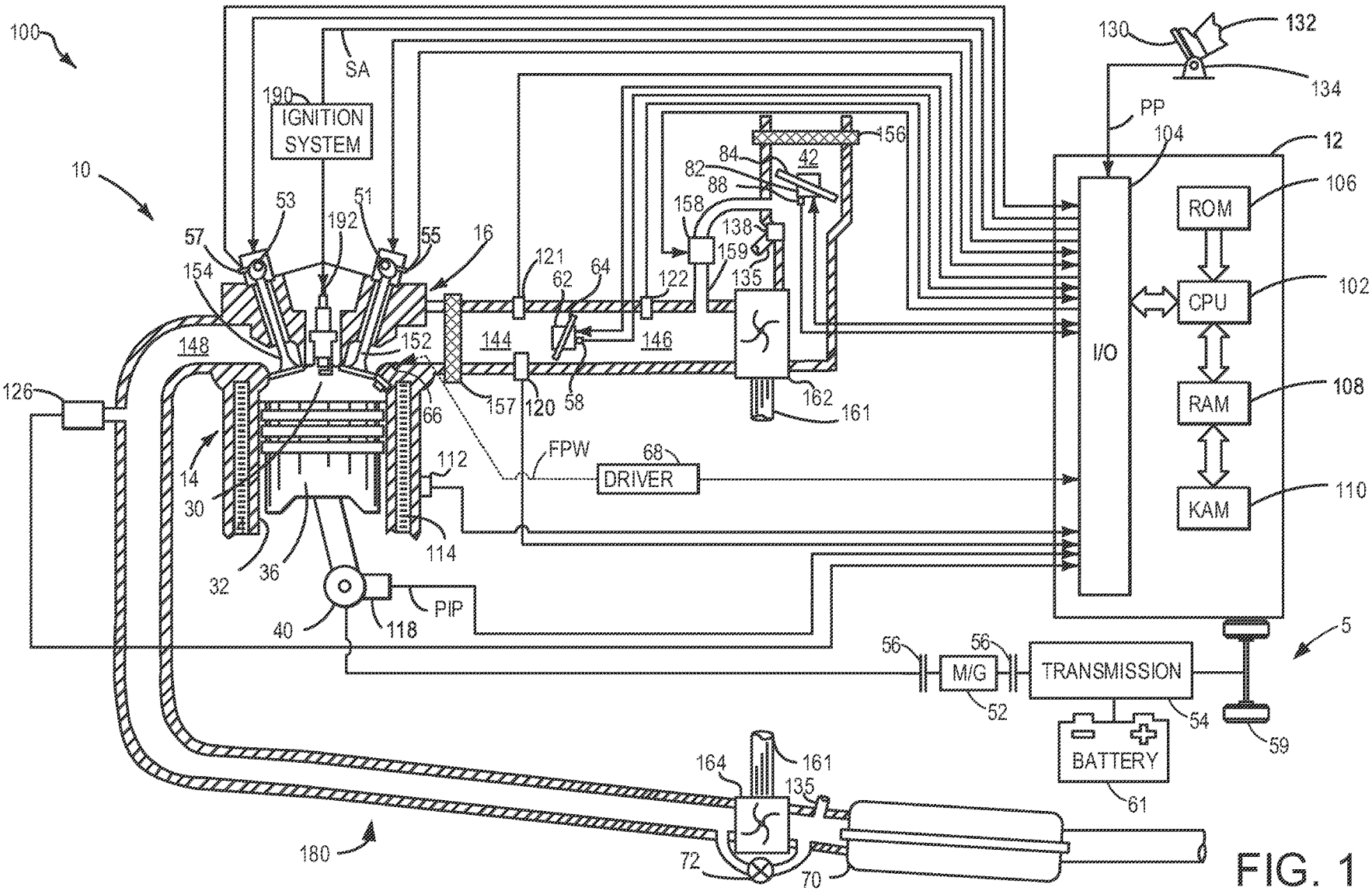
FIG. 1 illustrates a schematic of an engine included in a hybrid vehicle.
Figure 2:
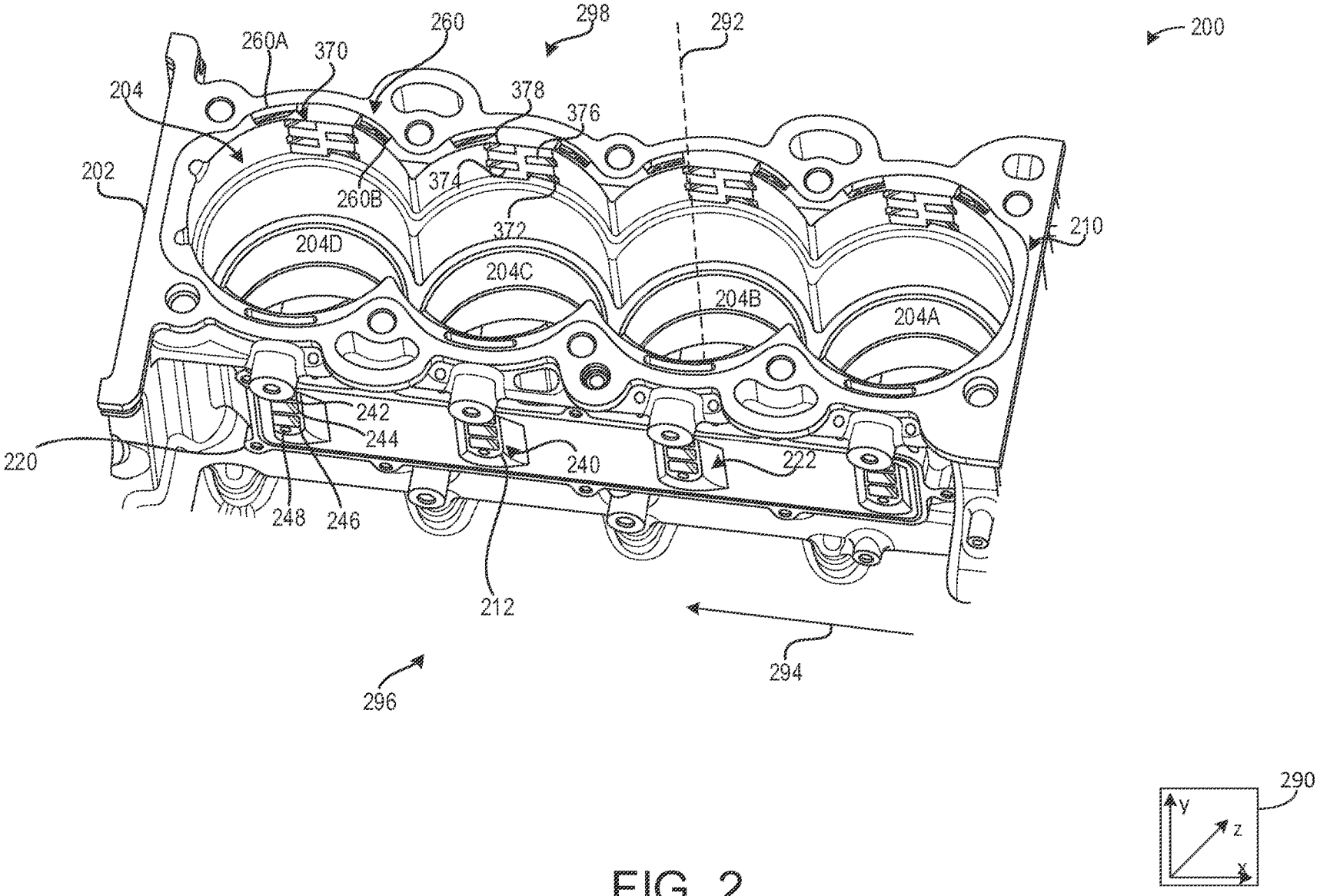
FIG. 2 illustrates a perspective view of an engine block of the engine comprising a coolant jacket stuffer.

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12.

Engine 10 includes a cylinder block 14 including at least one cylinder bore, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 1). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a NOx trap, selective catalytic reduction device, and combinations thereof. In some examples, a sensor may be arranged upstream or downstream of the emission control device 70, wherein the sensor may be configured to diagnose a condition of the emission control device 70.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

The cooling sleeve 114 may be interchangeably referred to as a coolant jacket herein. The coolant jacket 114 may optionally comprise an insert for directing a coolant flow therein. The coolant jacket 114 may comprise portions in the block 14 and in the head 16. As will be described in greater detail below with respect to FIG. 2, the cooling sleeve 114 may receive coolant from a single, inlet manifold. The cooling sleeve 114 is a single sleeve configured to flow coolant around each cylinder 30 of the engine 10.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 40 of engine 10 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 61 to provide torque to vehicle wheels 59. Electric machine 52 may also be operated as a generator to provide electrical power to charge battery 61, for example during a braking operation.

The controller 12 receives signals from the various sensors of FIG. 1 and employs the various actuators of FIG. 1 to adjust engine operation based on the received signals and instructions stored on a memory of the controller. For example, adjusting operation of the electric machine 52 may occur based on feedback from ECT sensor 112. As will be described in greater detail below, the engine 10 and electric machine 52 may be adjusted such that their operations may be delayed based on one or more of a powertrain temperature, which may be estimated based on feedback from ECT sensor 112, and a distance between an intended destination and an electric-only operation range.

Turning now to FIG. 2, it shows an embodiment 200 of an insert 210 arranged within a cylinder block 202. In one example, the cylinder block 202 is a non-limiting example of the cylinder block 14 of FIG. 1, wherein the insert 210 may be arranged within a coolant chamber of the block, such as coolant jacket 114 of FIG. 1.

An axis system 290 is shown comprising three axes, namely an x-axis parallel to a horizontal direction, a y-axis parallel to a vertical direction, and a z-axis perpendicular to each of the x- and y-axes. A central axis 292 may represent an axis about which a piston within a cylinder 204 of the cylinder block 202. In the example of FIG. 2, the cylinder block 202 may comprise four cylinders in an inline arrangement, wherein each of the cylinders is identical to the cylinder 204. It will be appreciated that the cylinder block 202 may be shaped to comprise different numbers and configurations of cylinders without departing from the scope of the disclosure.

The insert 210 may be arranged within the cylinder block 202 in an area between the cylinder block 202 and a combustion chamber of the cylinders. As will be shown in FIGS. 7A, 7B, 8, and 9, the insert 210 may be fitted in an area between the cylinder block 202 and cylinder liners of the cylinders. The area may correspond to a coolant jacket of the combustion chambers corresponding to the cylinder block 202. As will be described herein, the insert 210 may comprise one or more features for directing a flow of coolant within the coolant jacket.

In one example, the insert 210 is a two-piece insert. The two separate pieces are shown in a physically coupled arrangement in the example of FIG. 2. FIGS. 4A and 4B illustrate the first piece and FIGS. 5A and 5B illustrate the second piece. In the examples of FIGS. 4A to 5B, the first piece is smaller than the second piece. However, it will be appreciated that in some embodiments, the first and second pieces may be equal in size or the first piece may be larger than the second piece. Additionally or alternatively, the insert 210 is a single, continuous piece. At any rate, the insert 210 may be manufactured from a plastic material, such as a lightweight plastic material (e.g., polystyrenes, thermoplastics, LDPE, PCTFE, PETG, and the like). The insert 210 may be hollow. Hollow portions of the insert 210 correspond to one or more passages therein, the passages may be sized and shaped to accelerate coolant flows, thereby providing targeted, higher velocity coolant flows to hotter regions of the cylinder block 202 and a head, which may correspond to upper regions of the block around a top of the liners and combustion chambers adjacent to the head. In one example, the insert 210 is manufactured via additive manufacturing (e.g., 3D printing). However, the insert 210 may also be cast from a mold or manufactured via other techniques as known to those of ordinary skill in the art.

The cylinder block 202 comprises a coolant inlet manifold 220 having a plurality of coolant inlets 222. A number of coolant inlets 222 may correspond to a number of cylinders. As such, in the example of FIG. 2, there are exactly four coolant inlets 222.

The coolant inlets 222 may be shaped to receive and flow coolant to each of the coolant jackets corresponding to each of the cylinders. However, one issue with only using the coolant inlet manifold 220 and the coolant inlets 222 shaped therein is that coolant flow through the inlets to the coolant jackets may be biased and/or uneven. For example, a first cylinder 204A may receive a greater amount of coolant than each of a second cylinder 204B, a third cylinder 204C, and a fourth cylinder 204D. This may be due to coolant flowing in the direction of arrow 294, resulting in a majority of coolant flowing to the first cylinder 204A. Cooling effects may decline sequentially along the cylinders 204 such that cooling of the fourth cylinder 204D is less than cooling of the other three cylinders due to insufficient coolant flow.

The insert 210 may at least partially solve the above described issue along with other issues experienced during cylinder cooling. The insert 210 comprises a plurality of extensions 212 configured to traverse and fit within each of the coolant inlets 222. Each extension of the plurality of extensions 212 may be in face-sharing contact with interior surfaces of each coolant inlet of the coolant inlets 222.

In one example, the plurality of extensions 212 are inserted into the coolant inlets 222 when the first piece of the insert 210 is arranged in the cylinder block 202. Then, a remainder of the insert 210, such as the second piece of the insert 210, is arranged within the cylinder block 202. Cylinder liners may be subsequently arranged in cylinders 204 of the cylinder block 202, wherein the liners may press against the first and second pieces to fixedly arrange the insert 210 within the coolant jacket.

Each extension of the plurality of extensions 212 comprises a plurality of openings 240. The plurality of inlet openings 240 may direct coolant flow to different portions of the coolant jacket. The plurality of inlet openings 240 may comprise a first inlet opening 242, a second inlet opening 244, a third inlet opening 246, and a fourth inlet opening 248. Each of the first, second, and third inlet openings 242, 244, 246 may be similarly sized and shaped. The fourth inlet opening 248 may be smaller than and differently shaped than the first, second, and third inlet openings 242, 244, 246.

The insert 210 may further comprise a plurality of outlet openings 370. The plurality of outlet openings 370 may be arranged on an opposite side of the insert 210 relative to the plurality of inlet openings 240. In one example, the plurality of inlet openings 240 are arranged adjacent to an inlet side 296 of the insert 210 and the plurality of outlet openings 370 are arranged adjacent to an outlet side 298 of the insert 210.

The plurality of outlet openings 370 comprises a first outlet opening 372, a second outlet opening 374, a third outlet opening 376, and a fourth outlet opening 378. The first outlet opening 372 is arranged at a vertical position lower than the second outlet opening 374, which is arranged at a vertically lower position than the third outlet opening 376. The third outlet opening 376 is arranged vertically lower than the fourth outlet opening 378. The plurality of outlet openings 370 may zig-zag such that directly adjacent outlet openings are misaligned relative to the central axis 292 and to a circumference of the cylinder.

The plurality of inlets 240 and the plurality of outlet openings 370 may be fluidly coupled to coolant connecting passages configured to direct coolant from the coolant jacket in the cylinder block 202 to a coolant jacket in a cylinder head (e.g., cylinder head 16 of FIG. 1). The plurality of outlet openings 370 may direct coolant to a plurality of cutouts 260 arranged at the exhaust side 298 of the insert 210 configured to allow the plurality of outlet openings 370 to flow coolant to the cylinder head. The cutouts 260 may include a first set of cutouts 260A and a second set of cutouts 260B for fluidly coupling separate sets of outlet openings to the cylinder head. The plurality of outlet openings 370 may receive coolant from vertically distinct portions of an upper region of the cylinder block 202, wherein the upper region is closer to the cylinder head than a lower region. In one example, the upper region may correspond to a top-dead center position of the piston, and a position between the top-dead center position and a bottom-dead center position of the piston. Thus, a lower region may be distal to the cylinder head, vertically below the upper region, and may correspond to a portion of the block from the bottom-dead center position to the position between the top-dead center position. The lower region may be 1.1 to 2.0 times larger than the upper region. In some examples, additionally or alternatively, the lower region may be 1.1 to 1.8 times larger than the upper region. In some examples, additionally or alternatively, the lower region may be 1.1 to 1.6 times larger than the upper region. In some examples, additionally or alternatively, the lower region may be 1.2 to 1.6 times larger than the upper region. In some examples, additionally or alternatively, the lower region may be 1.4 to 1.6 times larger than the upper region. In one example, the lower region is equal in size to the upper region.

Turning now to FIGS. 3A to 9, they show various views of the insert 210. The embodiments of FIGS. 3A to 9 are described in tandem herein. Components previously introduced in the embodiment 200 of FIG. 2 may be similarly numbered in the embodiments of FIGS. 3A to 9.

Turning now to FIG. 3A, it shows an embodiment 300 of the insert 210 outside of the cylinder block (e.g., cylinder block 202 of FIG. 2). An embodiment 350 of a portion of the insert 210 corresponding to a single cylinder is shown in FIG. 3B.

In one example, the insert 210 is a coolant jacket stuffer, wherein the insert 210 comprises a plurality of features configured to direct coolant to a variety of locations within the coolant jacket. For example, the first inlet opening 242 directs coolant into a first connecting passage 362 fluidly coupled to a coolant jacket of a cylinder head. The second inlet opening 244 and the third inlet opening 246 direct different coolant flows to an upper region 310 of the coolant jacket via a second internal passage 364 and a third internal passage 366. The upper region 310 may be shaped via a lip 312 of the insert 210. In one example, the lip 312 is chamfered (e.g., angle cut) in a direction away from the upper region 310. This may allow coolant from the lower region to bleed-up more easily to the upper region, thereby promoting cooler coolant from the lower region to mix with hotter coolant in the upper region. By doing this, thermal demand of the cylinders is further met.

A location of the lip 312 is between a top 302 and a bottom 304 of the insert 210. The top 302 may be adjacent to a top-dead center location of a piston and the bottom 304 may be adjacent to a bottom-dead center location of the piston. The lip 312 may be biased toward the top 302 such that a distance 352 between the lip 312 and the top 302 is less than a distance 354 between the lip 312 and the bottom 304. In some examples, the distance 354 is 1.1 to 2.5 times larger than the distance 352. In some examples, additionally or alternatively, the distance is 1.1 to 2.0 times larger than the distance 352. In some examples, additionally or alternatively, the distance 354 is 1.1 to 1.8 times larger than the distance 352. In some examples, additionally or alternatively, the distance 354 is 1.2 to 1.8 times larger than the distance 352. In some examples, additionally or alternatively, the distance 354 is 1.3 to 1.7 times larger than the distance 352. In some examples, additionally or alternatively, the distance 354 is 1.4 to 1.6 times larger than the distance 352. In one example, the distance 354 is 1.5 times larger than the distance 352. At any rate, a volume of the upper region 310 is less than a volume of a lower region 311 of the coolant jacket. However, temperatures of the cylinder at the upper region 310 and in the cylinder head may be hotter than temperatures of the cylinder in the lower region 311. As such, the insert 210 is shaped to direct coolant to hotter regions of the cylinder to promote enhanced cooling, which may mitigate warping and other negative effects of insufficient cooling.

The first inlet opening 242 is fluidly coupled to the first internal passage 362. The first internal passage 362 may extend along an axis 392, which is angled relative to an axis 393, wherein the axis 393 may be parallel to a direction of coolant flow to the block via the coolant inlet manifold 220 of FIG. 2 (e.g., arrow 294 of FIG. 2). An angle 394 generated between the axis 392 and the axis 394 may be greater than 90 degrees and less than 180 degrees. In some examples, additionally or alternatively, the angle 394 is between 100 and 170 degrees. In some examples, additionally or alternatively, the angle 394 is between 110 and 160 degrees. In some examples, additionally or alternatively, the angle 394 is between 120 and 150 degrees. In some examples, additionally or alternatively, the angle 394 is between 130 and 140 degrees. In one example, the angle is 135 degrees.

The first internal passage 362 may turn from the axis 392 in a direction substantially parallel to the central axis 292. More specifically, interior surfaces of the first internal passage 362 may remain uniform in dimension along the axis 392 prior to turning in the direction parallel to the central axis. Interior surfaces of the first internal passage 362 may begin to curve, wherein dimensions of the first internal passage 362 are adjusted as the first internal passage extends toward a cylinder head. In one example, the first inlet opening 242 comprises a first inlet opening width and a first inlet opening height, wherein the width is measured along the x-axis and the height is measured along the y-axis. A first internal passage outlet 363 may comprise a first internal passage outlet width measured along the x-axis and a first internal passage outlet height measured along the z-axis. The first internal passage outlet width may be greater than the first inlet opening width. The first internal passage outlet height may be smaller than the first inlet opening height. A cross-sectional area of the first inlet opening 242 may be equal to a cross-sectional area of the first internal passage outlet 363. In other examples, the cross-sectional areas of the first inlet opening 242 and the first internal passage outlet 363 may be different. The dimensional changes of the first internal passage 362 may increase a coolant flow velocity, which may enhance cooling.

The first internal passage outlet 363 may direct coolant in the first internal passage 362 to a coolant jacket arranged in the cylinder head. As such, the first internal passage 362 may represent at least one feature of the insert 210 configured to direct coolant a hotter portion of engine. In one example, the cylinder head may be a hottest portion of the engine. Thus, the first internal passage 362 may ensure a desired amount of coolant is routed to the cylinder head to meet a cooling demand.

The first internal passage 362 may be fluidly sealed from each of a second internal passage 364, a third internal passage 366, and the upper region 310. As such, the first internal passage 362 may comprise no additional inlets or other outlets other than the first inlet opening 242 and the first internal passage outlet 363. Furthermore, coolant in the first internal passage 362 may not mix with coolant in any portion of the coolant jacket arranged within the cylinder block. As such, coolant in the first internal passage 362 does not enter the upper region 310 or mix with coolant in the upper region 310.

The insert 210 further comprises the second internal passage 364 and the third internal passage 366. The second internal passage 364 is fluidly coupled to the second inlet opening 244. The third internal passage 366 is fluidly coupled to the third inlet opening 246. As such, the second internal passage 364 may be arranged above the third internal passage 366 relative to the y-axis and the central axis 292.

The second internal passage 364 may extend from the second inlet opening 244 in the direction parallel to the axis 392, before turning in a direction substantially parallel to the central axis 292 toward a second internal passage outlet 365. A second inlet opening width, may be less than a second internal passage outlet width, each of the widths measured along the x-axis. A second inlet opening height, measured along the y-axis, may be greater than a second internal passage outlet height, measured along the z-axis. As such, the second internal passage 364 may twist and/or turn similarly to the first internal passage 362 such that a flow of coolant therein may shift in direction by approximately 90 degrees. Similar to the first internal passage 362, the second internal passage 364 and the third internal passage 366 may be shaped to increase a velocity of coolant through the coolant jacket in the cylinder block (e.g., cylinder block 202 of FIG. 2).

As described above, the insert 210 further comprises the plurality of outlets 370 including the first outlet 372, the second outlet 374, the third outlet 376, and the fourth outlet 378. The first outlet 372 may be misaligned with the second outlet 374 relative to the y-axis. The second outlet 374 may be misaligned with the third outlet 376 relative to the y-axis. The third outlet 376 may be misaligned with the fourth outlet 378 relative to the y-axis. Furthermore, the first outlet 372 may be aligned with the third outlet 376 along the y-axis and the second outlet 374 may be aligned with the fourth outlet 378 along the y-axis. In this way, the plurality of outlets 370 may alternate relative to the y-axis such that adjacent outlets are misaligned and vertically distinct from one another. By doing this, coolant distribution in the upper region 310 may be more uniform.

The first outlet 372 is configured to direct coolant from a lowest portion of the upper region 310 to a first outlet passage 373. The first outlet passage 373 may extend along a circumference of the insert 210 in a first direction before extending upward in a direction parallel to the y-axis. The first outlet passage 373 may be configured to direct coolant to the portion of the coolant jacket arranged in the cylinder head following coolant flowing from the intake side 296 of the upper region 310 to the exhaust side 298.

The second outlet 374 is configured to direct coolant from a second lowest portion of the upper region to a second outlet passage 375 from a circumferentially and a vertically distinct location relative to the first outlet 372. The second outlet passage 375 may extend along a circumference of the insert 210 in a second direction, opposite the first direction, before extending upward in a direction parallel to the y-axis. The second outlet passage 375 may be configured to direct coolant in a direction opposite the first outlet passage 373 before directing the coolant upward to the portion of the coolant jacket arranged in the cylinder head.

The third outlet 376 is configured to direct coolant from a second highest portion of the upper region 310 to a third outlet passage 377 from a circumferentially and a vertically distinct location relative to the second outlet 374. The third outlet passage 377 may be similarly shaped to the first outlet passage 373 wherein the third outlet passage 377 extends in the first direction before extending upward in the direction parallel to the y-axis. The third outlet passage 376 is configured to direct coolant upward to the portion of the coolant jacket arranged in the cylinder head.

The fourth outlet 378 is configured to direct coolant from a highest portion of the upper region 310 to a fourth outlet passage 379 from a circumferentially and a vertically distinct location relative to the third outlet 376. The fourth outlet passage 379 may be similarly shaped to the second outlet passage 275 extends in the second direction before extending upward in the direction parallel to the y-axis. The fourth outlet passage 378 is configured to direct coolant upward to the portion of the coolant jacket arranged in the cylinder.

In one example, the insert 210 comprises features for directing coolant relative to each cylinder of an engine. As such, in the examples of FIGS. 2, 3A, and 3B, the engine comprises four cylinders, wherein the insert comprises an extension, a plurality of inlet openings, a plurality of internal passage, a plurality of outlets, and a plurality of outlet passages. Each of the features may be configured to direct a majority of coolant to the upper region of the coolant jacket in the cylinder block and to a portion of the coolant jacket in the cylinder head.

The insert 210 is shaped to engage with coolant in portions of the coolant jacket relative to each of the individual cylinders of the engine. As such, the insert 210 is shaped to surround each of the individual cylinders within the cylinder block. However, the insert 210 may not be shaped to extend to regions between adjacent cylinders. As such, the insert 210 may comprise an undulating shape, mimicking a curvature of the cylinder of the engine or of a cylinder bank of the engine.

Thus, the insert 210 comprises at least three internal inlet passages and four outlet passages per cylinder. Each of the internal passages is shaped to increase a coolant flow velocity to enhance cooling through the block and head. The outlet passages are arranged to promote even distribution of coolant through the upper region to mitigate formation of hot spots.

Turning now to FIGS. 4A and 4B, they show embodiments 400 and 450, respectively, of a first piece 410 of the insert 210. Embodiment 400 illustrates a view from the intake side 296 of the first piece 410. Embodiment 450 illustrates a view from the exhaust side 298 of the first piece 410, wherein features of the first piece 410 arranged in the coolant jacket are shown.

As shown in FIG. 4A, the first piece 410 of the insert comprises the extensions 212. As described above, the extensions 212 comprises the plurality of openings 240 which are configured to receive coolant from a coolant passage leading to the engine block. The first piece 410 further comprises the first internal passage outlet 363 along with the first internal passage, the second internal passage, and the third internal passage, which are occluded in the present view due to an outer wall of the first piece. The outer wall may be in face-sharing contact with an interior surface of the cylinder block.

As shown in FIG. 4B, the first piece 410 comprises a flow diverter 420 shaped to engage with coolant in the upper region 310. Herein, the upper region 310 represents a volume of the coolant jacket in the cylinder block between the lip 312 and an upper edge 412 of the first piece. A wall, such as a lower wall of the cylinder head, may seal a top portion of the upper region 310 to block coolant from exiting the coolant jacket within the cylinder block.

The upper region 310 may receive coolant from each of the second internal passage outlet 365 and the third internal passage outlet 367. The flow diverter 420 comprises a first arm 422 and a second arm 424 that intersect at a body 426. The body 426 may be physically coupled to the lip 312 and its thickness, measured along the z-axis, may be equal to a thickness of the lip 312. The first arm 422 and the second arm 424 may curve away from one another as they extend from the body 426. In one example, the curve of each of the arms may be such that an extreme end of the arms points in a direction angled 90 degrees relative to a longitudinal axis of the body 426. In one example, the longitudinal axis is parallel to the central axis 292 of the cylinder, shown in FIG. 2.

The first arm 422 may direct a first coolant flow from the second internal passage outlet 365 in a first direction. In one example, the first direction is a clockwise direction. The second arm 424 may direct a second coolant flow from the third internal passage outlet 367 in a second direction, opposite the first direction. In one example, the second direction is a counterclockwise direction. The first coolant flow and the second coolant flow may flow between the lip 312 and the lower wall of the cylinder head around the upper region toward the plurality of outlets (e.g., the plurality of outlets 370) on the exhaust side of the engine block.

In some examples, the first coolant flow may collide and mix with the second coolant flow at a location between adjacent cylinders. A peak 470 of the tip 312 may be arranged adjacent to a space between adjacent cylinder liners of adjacent cylinders. As such, if the insert 210 is shaped for a four-cylinder engine, the insert 210 may comprise three of the peak 470 shaped into the tip 312. The peak 470, along with the collision between coolant flows, may promote coolant flow between adjacent cylinders while maintaining the coolant flow in the portion of the upper region between adjacent cylinders, where temperatures may be hotter relative to portions of the cylinders facing the engine block or in a lower region.

The fourth inlet opening 248 may be configured to flow coolant to a lower region 460 of the coolant jacket in the cylinder block. The coolant flow from the fourth inlet opening 248 may circulate coolant in the lower region 460 in order to maintain coolant flow and prevent coolant stagnation. Coolant in the lower region 460 may mix with coolant in the upper region 310 at locations between adjacent cylinders or adjacent to the exhaust side where the plurality of outlet 370 are arranged. As such, the lower region 460 may leak and/or bleed coolant up to the upper region 310 between the insert 210 and corresponding cylinder liners of each cylinder.

The first piece 410 may further comprise a plurality of coolant circulation openings 452 configured to circulate coolant between the first arm 422 and the second arm 424. In one example, coolant may stagnate in the region between the first arm 422 and the second arm 424. However, by flowing coolant through the plurality of coolant circulation openings 452, stagnation may be prevented. In one example, the plurality of coolant circulation openings 452 may receive coolant from the first internal passage (e.g., first internal passage 362 of FIG. 3A). Coolant in the region between the first arm 422 and the second arm 424 may bleed and/or leak part the first and second arms 422, 424 of the flow diverter 420 and mix with coolant in the upper region 310. That is to say, coolant from the plurality of coolant circulation openings 452 may mix with coolant from the second internal passage outlet 365 and the third internal passage outlet 367 in the upper region 310.

Turning now to FIGS. 5A and 5B, they show embodiments 500 and 550, respectively, of a second piece 510 of the insert 210. The embodiment 500 illustrates a view of the second piece 510 from the intake side 296, as shown in FIG. 2. The embodiment 550 illustrates a view of the second piece 510 from the exhaust side 298, as shown in FIG. 2. The embodiment 500 reveals the plurality of outlets 370 and the plurality of outlet passages. More specifically, the embodiment 500 illustrates a first outlet 372, a first outlet passage 373, a second outlet 374, a second outlet passage 375, a third outlet 376, a third outlet passage 377, a fourth outlet 378, and a fourth outlet passage 379.

The embodiment 550 reveals a first cutout 560 and a second cutout 570 arranged at the exhaust side 298 of the second piece 510. The first cutout 560 may be configured to allow coolant from the first outlet passage 373 and the third outlet passage 377 to flow therethrough and to the portion of the coolant jacket arranged in the cylinder head. As such, coolant in the first outlet passage 373 and the third outlet passage 377 may be maintained separate from one another until reaching the first cutout 560, where the coolant flows may mix prior to flowing to the coolant jacket in the cylinder head. The second cutout may be configured to allow coolant from the second outlet passage 375 and the fourth outlet passage 379 to flow therethrough and to the portion of the coolant jacket arranged in the cylinder head. As such, coolant in the second outlet passage 375 and the fourth outlet passage 379 may be maintained separate from one another until reaching the second cutout 570, where the coolant flows may mix prior to flowing to the coolant jacket in the cylinder head.

When the first piece 410, shown in FIG. 4A, is arranged in the cylinder block, the extensions 212 may be inserted into the plurality of coolant inlets 222 of the coolant inlet manifold 220, illustrated in FIG. 2. Subsequently, the second piece 510 may be inserted in the cylinder block in face-sharing contact with the first piece 410 such that the first and second piece are contiguous. The cylinder liners, illustrated in FIGS. 7, 8, and 9 may be arranged with a bore shaped by the first piece 410 and the second piece 510, corresponding to an area of the combustion chamber. The cylinder liners may sandwich the first piece 410 against the intake side 296 of the block and the second piece 510 against the exhaust side 298 of the block.

In some examples, the extensions 212 may be used to promote coolant flow into each portion of the coolant jacket corresponding to each cylinder to promote even cooling of each cylinder. This may occur due to a venturi effect at each opening of the plurality of openings 240. However, in some examples, to decrease manufacturing costs for engines with less cooling demands, the extensions 212 may be omitted such that the insert 210 may be manufactured as a single, continuous piece. The insert may be forced in the engine block without a portion of the insert extending through the coolant inlets of the block. The liners may be subsequently arranged to lock the insert in place.

Turning now to FIG. 6, it shows an embodiment 600 of the insert 210. The view of the embodiment 600 is from the exhaust side 298. The embodiment 600 illustrates a shape of the outlet passages extending toward the first cutouts 560 and the second cutouts 570. As described above, the outlet passages may receive coolant from the coolant jacket arranged in the block via a corresponding outlet, wherein the coolant flows through a single outlet passage toward one of the first or second cutout of the first and second cutouts 560, 570.

More specifically, the first outlet passage 373 receives a first coolant flow in a first direction parallel to the z-axis, turns the first coolant flow in a second direction parallel to the x-axis, and then turns the first coolant flow in a third direction parallel to the y-axis toward the first cutout. The second outlet passage 375 receives a second coolant flow in the first direction, turns the second coolant flow in a fourth direction, opposite the second direction, parallel to the x-axis, and then turns the second coolant flow in the third direction toward the second cutout. The third outlet passage 377 receives a third coolant flow in the first direction, turns the second coolant flow in the second direction, and then turns the second coolant flow in the third direction toward the first cutout. The third coolant flow and the first coolant flow may mix at the first cutout as they flow to the portion of the coolant jacket arranged in the cylinder head. Additionally or alternatively, the first coolant flow and the third coolant flow may be maintained separate as they flow through the first cutout toward the portion of the coolant jacket in the cylinder head. The fourth outlet passage receives a fourth coolant flow in the first direction, turns the fourth coolant flow in the fourth direction, and then turns the fourth coolant flow in the third direction toward the second cutout. The second coolant flow and the fourth coolant flow may mix or be maintained separate as they flow through the second cutout toward the portion of the coolant jacket in the cylinder head.

Additionally or alternatively, the first, second, third, and fourth coolant flows may mix in the portion of the coolant jacket in the cylinder head. In some examples, some of the flows, such as the first and third flows, may be directed to a first portion of the coolant jacket in the cylinder head and a remainder of the coolant flows may be directed to a second portion, different than the first portion, of the coolant jacket in the cylinder head. As such, targeted coolant flow in the cylinder head may also be achieved via the insert 210.

Turning now to FIGS. 7A and 7B, they illustrate a first view 700 and a second view 750 of a cylinder liner 704 being arranged adjacent to the insert 210. The first view 700 is from the exhaust side 298 and the second view 750 is from the intake side 296. A cylinder liner of the cylinder 204A is omitted to reveal features of the cylinder liner 704.

The cylinder liner 704 comprises a plurality of fins 706 that extend along an area between adjacent cylinders. As such, the plurality of fins 706 may not be in face-sharing contact with the insert 210. In one example, the plurality of fins 706 are arranged only in an area corresponding to the upper region 310 of the coolant jacket. In one example, the plurality of fins 706 are configured to further promote coolant flow through the area between adjacent cylinders. Coolant flows from the second internal passage 365 and the third internal passage 367 may collide adjacent to the plurality of fins 706, wherein the fins may promote coolant flow therethrough, thereby enhancing cooling in the portion of the upper region 310 between adjacent cylinder where coolant may otherwise struggle to flow through.

Turning now to FIG. 8, it shows a cross-section 800 taken along the cutting plane A-A' of FIG. 7B. The cross-section 800 reveals an internal shape of the first internal passage 362, the second internal passage 364, and the third internal passage 366. As shown, the second internal passage 364 may extend within an area between the first internal passage 362 and a cylinder liner of the first cylinder 204A. This may at least partially block thermal communication between the first internal passage 362 and the first cylinder 204A, such that cooler coolant may flow to the cylinder head via the first internal passage 362.

The cross-section 800 further illustrates an internal shape of the first outlet passage 373, the second outlet passage 375, the third outlet passage 377, and the fourth outlet passage 379. Each of the first, second, third, and fourth outlet passages follows a curvature of the insert 210, and therefore a curvature of the first cylinder 204A. Furthermore, the cross-section 800 further reveals a vertical arrangement of the outlet passages, wherein the first outlet passage 373 is below the second outlet passage 375, which is below the third outlet passage 377, wherein the third outlet passage 377 is below the fourth outlet passage 379. The vertical arrangement of the outlet passages 370 may promote coolant flow at various vertical positions of the upper region 310.

The cross-section 800 further reveals spaces between adjacent fins of the plurality of fins 706 of the cylinder liner 704, which may be common to other liners associated with the other cylinders of the engine. The spaces may be referred to as a plurality of circular coolant passages 806 herein. Each circular coolant passage of the plurality of circular coolant passages 806 may be arranged between adjacent fins of the plurality of fins 706. As such, adjacent fins may be spaced apart from one another via a circular coolant passage. In some examples, the plurality of fins 706, and therefore the plurality of circular coolant passages 806 may extend around an entire circumference of a single cylinder, such that the plurality of fins 706 and the plurality of circular coolant passages 806 may direct coolant flow within the upper region 310 of the cylinder.

Turning now to FIG. 9, it shows an embodiment 900 where cylinder liners of the first cylinder 204A and the second cylinder 204B are omitted. As such, a cylinder liner 904 of the third cylinder 204C is shown. The cylinder liner 904 may be substantially similar to the cylinder liner 704 in size and shape. As such, the cylinder liner 904 may also comprise a plurality of fins 906 along with a plurality of circular coolant passages 908. The embodiment 900 further illustrates an engagement of coolant from the second internal passage outlet 365 corresponding to the first cylinder 204A with coolant from the third internal passage outlet 367 corresponding to the second cylinder 204B. The coolant flows mix at the peak 470 of the insert 210 arranged at a location between the first cylinder 204A and the second cylinder 204B. The coolant flows mix and flow through the circular coolant passages arranged between adjacent fins of the plurality of fins of the cylinder liners of the first and second cylinders 204A, 204B while remaining in the upper region 310.

In this way, a coolant arrangement of an engine may be enhanced via an insert comprising one or more internal passages shaped to promote flow of coolant to hotter regions of the engine. The technical effect of redirecting coolant directly to portions of the coolant jacket in the cylinder head and upper region of the cylinder block is to increase coolant flow to hotter regions of the engine. Additionally, the internal passages may be shaped to increase a coolant flow velocity and evenly distribute coolant flow from a coolant inlet manifold to a plurality of portions of the insert corresponding to cylinders of the engine.

An embodiment of a system, comprises an insert arranged in a portion of a coolant jacket in a block, wherein the insert comprises a first internal passage configured to flow coolant directly to a portion of the coolant jacket in a head without mixing with coolant in the portion of the coolant jacket in the block.

A first example of the system further comprises where the insert further comprises a second internal passage and a third internal passage, wherein the second and third internal passages are configured to flow coolant to an upper region of the portion of the coolant jacket in the block, wherein the upper region is arranged between a lower surface of the head and a lip of the insert.

A second example of the system, optionally including the first example, further comprises where the second internal passage is configured to direct coolant in a clockwise direction and the third internal passage is configured to direction coolant in a counterclockwise direction.

A third example of the system, optionally including one or more of the previous examples, further includes where the first, second, and third internal passages are fluidly sealed from one another.

A fourth example of the system, optionally including one or more of the previous examples, further includes where a number of the first internal passage, the second internal passage, and the third internal passage is equal to a number of cylinders arranged in the block.

A fifth example of the system, optionally including one or more of the previous examples, further includes where the second internal passage is arranged in a portion of the insert between the first internal passage and a cylinder liner.

A sixth example of the system, optionally including one or more of the previous examples, further includes where the first, second, and third internal passages are arranged adjacent to an intake side of the block, wherein the insert further comprises a plurality of outlet passages arranged adjacent to an exhaust side of the block opposite the intake side, wherein the plurality of outlet passages receive coolant from only the second and third internal passages.

A seventh example of the system, optionally including one or more of the previous examples, further includes where the insert is sandwiched between the block and a plurality of cylinder liners.

An embodiment of an engine, comprises a plurality of cylinders configured to thermally communicate with coolant in a cylinder head coolant jacket and a cylinder block coolant jacket and an insert arranged in the cylinder block coolant jacket sandwiched between interior surfaces of a cylinder block and exterior surfaces of a plurality of cylinder liners, wherein the insert comprises a plurality of internal passages adjacent to an intake side of the cylinder block coolant jacket, wherein a first internal passage is configured to divert coolant from an inlet of the cylinder block coolant jacket directly to the cylinder head coolant jacket, wherein the insert further comprises a second internal passage and a third internal passage configured to flow coolant to only an upper region of the cylinder block coolant jacket.

A first example of the engine further comprises where the upper region is arranged between a lip of the insert and a bottom surface of a cylinder head, wherein the lip of the insert is chamfered.

A second example of the engine, optionally including the first example, further comprises where the insert comprises a plurality of outlet passages arranged adjacent to an exhaust side of the cylinder block coolant jacket opposite the intake side, wherein each of the plurality of outlet passages are vertically or circumferentially distinct from one another.

A third example of the engine, optionally comprising one or more of the previous examples, further comprises where the plurality of outlet passages receive coolant from only the upper region, wherein the plurality of outlet passages direct coolant to the cylinder head coolant jacket.

A fourth example of the engine, optionally comprising one or more of the previous examples, further comprises where the plurality of outlet passages is fluidly separated from one another.

A fifth example of the engine, optionally comprising one or more of the previous examples, further comprises wherein the insert further comprises a flow diverter for directing coolant flows from the second internal passage and the third internal passage in opposite directions within the upper region.

A sixth example of the engine, optionally comprising one or more of the previous examples, further comprises where a coolant flow of the second internal passage of a first cylinder merges with a coolant flow of the third internal passage of a second cylinder at a location between the first and second cylinders, wherein the coolant flow flows through spaces between adjacent fins of the plurality of fins.

An embodiment of a coolant system comprises a coolant jacket for an engine comprising a first portion arranged in a cylinder block and a second portion arranged in a cylinder head, a coolant inlet manifold fluidly coupled to the first portion, a coolant jacket insert arranged in the first portion sandwiched between the cylinder block and surfaces of a plurality of cylinder liners facing interior surfaces of the cylinder block, a first internal passage of the coolant jacket insert configured to direct coolant from the coolant inlet manifold directly to the second portion, a second internal passage of the coolant jacket insert configured to direct coolant to an upper region of the first portion, and a third internal passage of the coolant jacket insert configured to direct coolant to the upper region of the first portion, and a plurality of outlet passages arranged on an opposite side of the coolant jacket insert relative to the first, second, and third internal passages, wherein the plurality of outlet passages are arranged at vertically distinct positions on an exhaust side of the coolant jacket insert.

A first example of the coolant system further comprises where the second internal passage is arranged between the first internal passage and the upper region.

A second example of the coolant system, optionally including the first example, further comprises where the upper region is defined by a lip of the insert and a bottom surface of the cylinder head, wherein the second internal passage directs a first coolant flow in a first direction into the upper region, wherein the third internal passage directs a second coolant flow in a second direction, opposite the first direction, into the upper region, wherein the first and second coolant flows mix at a point of the lip, wherein the point is adjacent to a space between adjacent cylinder liners.

A third example of the coolant system, optionally including one or more of the previous examples, further comprises where outlets of the first internal passage, the second internal passage, and the third internal passage are configured to increase a velocity of a coolant flow.

A fourth example of the coolant system, optionally including one or more of the previous examples, further comprises where the second portion of the coolant jacket is fluidly coupled to the first portion of the coolant jacket via only the first internal passage and the plurality of outlet passages.

In another representation, the coolant jacket insert is arranged in a coolant jacket of an engine block of an engine of a hybrid vehicle.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an insert arranged in a portion of a coolant jacket in a block, wherein the insert comprises a first internal passage configured to flow coolant directly to a portion of the coolant jacket in a head without mixing with coolant in the portion of the coolant jacket in the block, wherein the insert further comprises a second internal passage and a third internal passage, wherein the second and third internal passages are configured to flow coolant to an upper region of the portion of the coolant jacket in the block, wherein the upper region is arranged between a lower surface of the head and a lip of the insert, wherein an engine comprises the block and the head.

2. The system of claim 1, wherein the second internal passage is configured to direct coolant in a clockwise direction and the third internal passage is configured to direction coolant in a counterclockwise direction.

3. The system of claim 1, wherein the first, second, and third internal passages are fluidly sealed from one another.

4. The system of claim 1, wherein a number of the first internal passage, the second internal passage, and the third internal passage is equal to a number of cylinders arranged in the block.

5. The system of claim 1, wherein the second internal passage is arranged in a portion of the insert between the first internal passage and a cylinder liner.

6. The system of claim 1, wherein the first, second, and third internal passages are arranged adjacent to an intake side of the block, wherein the insert further comprises a plurality of outlet passages arranged adjacent to an exhaust side of the block opposite the intake side, wherein the plurality of outlet passages receive coolant from only the second and third internal passages.

7. The system of claim 1, wherein the insert is sandwiched between the block and a plurality of cylinder liners.

8. An engine, comprising:

a plurality of cylinders configured to thermally communicate with coolant in a cylinder head coolant jacket and a cylinder block coolant jacket; and an insert arranged in the cylinder block coolant jacket sandwiched between interior surfaces of a cylinder block and exterior surfaces of a plurality of cylinder liners, wherein the insert comprises a plurality of internal passages adjacent to an intake side of the cylinder block coolant jacket, wherein a first internal passage is configured to divert coolant from an inlet of the cylinder block coolant jacket directly to the cylinder head coolant jacket, wherein the insert further comprises a second internal passage and a third internal passage configured to flow coolant to only an upper region of the cylinder block coolant jacket.

9. The engine of claim 8, wherein the upper region is arranged between a lip of the insert and a bottom surface of a cylinder head, wherein the lip of the insert is chamfered.

10. The engine of claim 8, wherein the insert comprises a plurality of outlet passages arranged adjacent to an exhaust side of the cylinder block coolant jacket opposite the intake side, wherein each of the plurality of outlet passages are vertically or circumferentially distinct from one another and arranged in a zig-zag formation.

11. The engine of claim 10, wherein the plurality of outlet passages receive coolant from only the upper region, wherein the plurality of outlet passages direct coolant to the cylinder head coolant jacket.

12. The engine of claim 10, wherein the plurality of outlet passages is fluidly separated from one another.

13. The engine of claim 8, wherein the insert further comprises a flow diverter for directing coolant flows from the second internal passage and the third internal passage in opposite directions within the upper region.

14. The engine of claim 8, wherein a coolant flow of the second internal passage of a first cylinder merges with a coolant flow of the third internal passage of a second cylinder at a location between the first and second cylinders, wherein the coolant flow flows through spaces between adjacent fins of a plurality of fins.

15. A coolant system, comprising:

a coolant jacket for an engine comprising a first portion arranged in a cylinder block and a second portion arranged in a cylinder head;

a coolant inlet manifold fluidly coupled to the first portion;

a coolant jacket insert arranged in the first portion sandwiched between the cylinder block and surfaces of a plurality of cylinder liners facing interior surfaces of the cylinder block;

a first internal passage of the coolant jacket insert configured to direct coolant from the coolant inlet manifold directly to the second portion, a second internal passage of the coolant jacket insert configured to direct coolant to an upper region of the first portion, and a third internal passage of the coolant jacket insert configured to direct coolant to the upper region of the first portion; and a plurality of outlet passages arranged on an opposite side of the coolant jacket insert relative to the first, second, and third internal passages, wherein the plurality of outlet passages are arranged at vertically distinct positions on an exhaust side of the coolant jacket insert.

16. The coolant system of claim 15, wherein the second internal passage is arranged between the first internal passage and the upper region.

17. The coolant system of claim 15, wherein the upper region is defined by a lip of the insert and a bottom surface of the cylinder head, wherein the second internal passage directs a first coolant flow in a first direction into the upper region via a first arm of a flow diverter, wherein the third internal passage directs a second coolant flow in a second direction, opposite the first direction, into the upper region via a second arm of the flow diverter, wherein the flow diverter comprises a Y-shape and wherein the first and second coolant flows mix at a point of the lip, wherein the point is adjacent to a space between adjacent cylinder liners.

18. The coolant system of claim 15, wherein outlets of the first internal passage, the second internal passage, and the third internal passage are configured to increase a velocity of a coolant flow.

19. The coolant system of claim 15, wherein the second portion of the coolant jacket is fluidly coupled to the first portion of the coolant jacket via only the first internal passage and the plurality of outlet passages.

* * * * *